United States Patent [19]

Kodama

[11] 4,338,894

[45] Jul. 13, 1982

[54] SELF-CONTAINED HYDRAULIC LASH ADJUSTER

[75] Inventor: Hisashi Kodama, Toyota, Japan

[73] Assignee: Aisin Seiki Kabushiki Kaisha, Kariya, Japan

[21] Appl. No.: 229,750

[22] Filed: Jan. 29, 1981

Related U.S. Application Data

[63] Continuation of Ser. No. 31,092, Apr. 18, 1979, abandoned.

[30] Foreign Application Priority Data

Apr. 20, 1978 [JP] Japan ..... 53-53206[U ]
Apr. 24, 1978 [JP] Japan ..... 53-54763[U]

[51] Int. Cl.[3] ..... F01L 1/24
[52] U.S. Cl. ..... 123/90.58; 123/90.46; 123/90.43
[58] Field of Search ..... 123/90.41, 90.43, 90.45, 123/90.46, 90.52, 90.53, 90.55, 90.57, 90.58, 90.59

[56] References Cited

U.S. PATENT DOCUMENTS

| | | | |
|---|---|---|---|
| 2,925,074 | 2/1960 | Dadd | 123/90.59 |
| 2,956,557 | 10/1960 | Dadd | 123/90.55 |
| 3,670,707 | 6/1972 | Guido | 123/90.58 |
| 3,861,365 | 1/1975 | Zink | 123/90.46 |
| 4,191,142 | 3/1980 | Kodama | 123/90.58 |

*Primary Examiner*—Craig R. Feinberg
*Assistant Examiner*—W. R. Wolfe
*Attorney, Agent, or Firm*—Sughrue, Mion, Zinn, Macpeak & Seas

[57] ABSTRACT

A self-contained hydraulic lash adjuster which does not depend upon any external source of hydraulic fluid in operation is used in the valve trains of internal combustion engines or similar mechanisms in order to take up the lash or operating clearance in the valve trains. In the lash adjuster a transmitting member such as a fulcrum is engaged with a plunger which is slidably mounted in a bore of a lash adjuster body. A clearance is provided between the transmitting member and the body which is smaller than the clearance provided between the transmitting member and the plunger to reduce the frictional wear between the plunger and the body.

3 Claims, 3 Drawing Figures

SELF-CONTAINED HYDRAULIC LASH ADJUSTER

This is a continuation, of application Ser. No. 31,092, filed Apr. 18, 1979, now abandoned.

BACKGROUND OF THE INVENTION

1. Field of the Invention

This invention relates to hydraulic lash adjusters as used in the valve trains of internal combustion engines or similar mechanisms and more particularly to hydraulic lash adjusters of the self-contained type in which the fluid is sealed within the assembly with no provision for its replacement from any external source during operation.

2. Prior Art

The conventional lash adjuster of this type comprises a cylindrical body with a blind bore and a plunger slidably mounted in the blind bore. When the plunger is moved in the axial direction by the force applied thereto through a transmitting member such as a fulcrum in engagement therewith, the plunger is simultaneously urged to move in the radial direction of the body and the outer surface of the plunger is brought into contact with the inner surface of the body by a component of the force since the direction of the force does not correspond to the axis of the plunger. Between the inner surface of the body and the outer surface of the plunger, there is provided a leakage clearance through which a very small amount of silicone oil passes. Since the silicone oil has little or no lubricating effect, the inner surface of the body and the outer surface of the plunger will be subjected to frictional wear thereby decreasing the accuracy of the lash adjuster in operation.

SUMMARY OF THE INVENTION

The present invention provides a new and improved hydraulic lash adjuster which will overcome the above-mentioned drawbacks.

The present invention provides a new and improved hydraulic lash adjuster wherein uneven frictional wear between the vertically movable plunger and the cylindrical body is avoided thereby ensuring the accurate operation of the lash adjuster.

The present invention provides a new and improved hydraulic lash adjuster which is simple in construction and is inexpensive in cost.

The foregoing and other objects, features and advantages of the present invention will be apparent from the following description of a preferred embodiment with reference to the attached drawings.

DETAILED DESCRIPTION OF THE INVENTION

Figure 1:
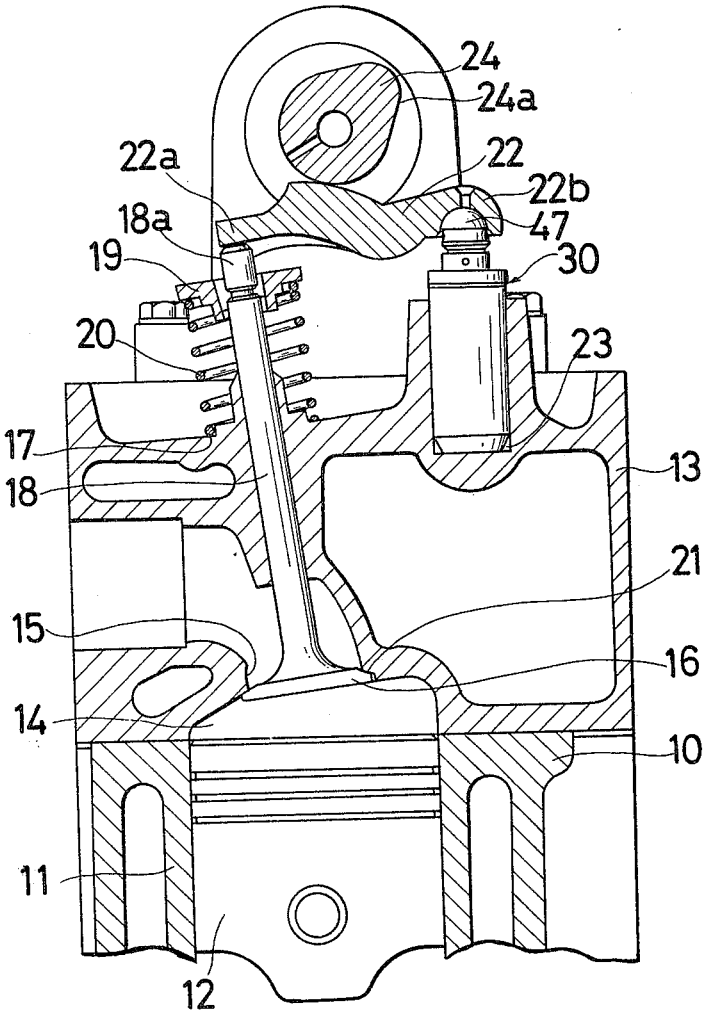
FIG. 1 is a transverse sectional view through a portion of an internal combustion engine having a valve operating train incorporating an hydraulic lash adjuster constructed in accordance with the present invention.

Referring now in detail to the drawings, there is illustrated in FIG. 1 an internal combustion engine having a cylinder block 10 containing a bore 11 in which a piston 12 is reciprocably mounted. The engine includes a cylinder head 13 secured to the top of the cylinder block 10 thereby forming a combustion chamber 14 above the piston 12.

The communication between the combustion chamber 14 and a head port 15 is controlled by a poppet valve 16 which cooperates with a seat 21. The valve 16 has a stem 18 slidably mounted for reciprocation in the cylinder head 13. A valve return spring comprised of a helical tortion spring surrounding the valve stem 18 is disposed between a spring seat 17 on the cylinder head 13 and a retainer 19 fixed to the upper end of the valve stem 18. The spring 20 serves to maintain the valve 16 normally in its closed position as illustrated in FIG. 1.

The cylinder head 13 is further provided with a cylindrical blind bore 23 in which a lash adjuster 30 according to the present invention is fitted. A fulcrum 47 is engaged with one end **22*b* of a rocker arm 22. The other end 22*a* of the rocker arm 22 is engaged with an upper end 18*a* of the stem 18. The rocker arm 22 is in contact with an outer surface 24*a* of a lobed cam 24 operatively connected to a crankshaft (not shown) and the opening and closing of the valve 16 is controlled by the rocking movement of the rocker arm 22**.

Figure 2:
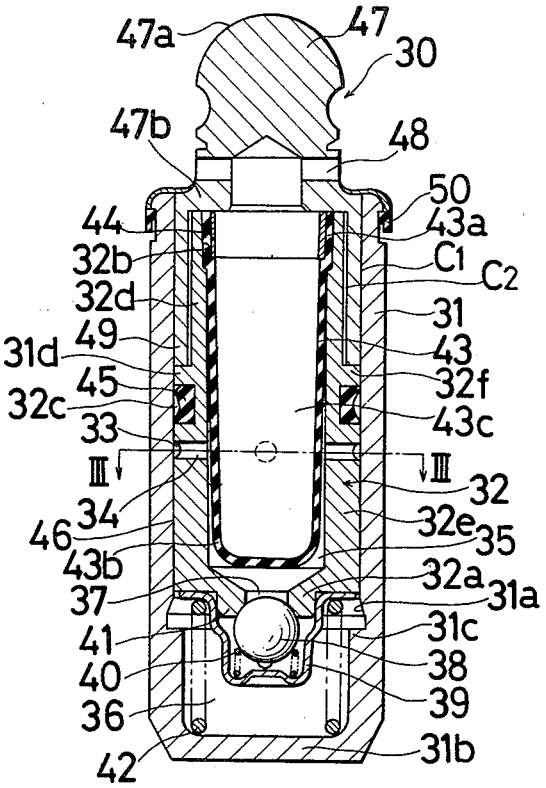
FIG. 2 is an enlarged longitudinal sectional view through the lash adjuster of FIG. 1 showing the internal construction in detail.
Figure 3:
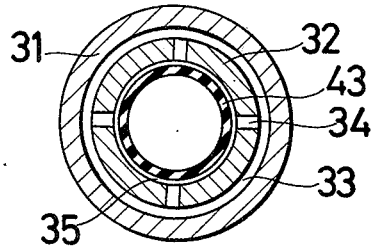
FIG. 3 is a sectional view through the lash adjuster taken along the line III—III of FIG. 2.

As illustrated in FIGS. 2 and 3, the lash adjuster 30 is comprised generally of a cup-shaped body 31 having a blind bore **31*a* with a step portion 31*c*. In the blind bore 31*a* there is slidably mounted a step plunger 32 having an upper portion 32*d* and a lower portion 32*e*. The external diameter of the upper portion 32*d* is smaller than the external diameter of the lower portion 32*e***.

A fluid pressure chamber 36 is formed between the closed end **31*b* of the body 31 and the bottom wall 32*a* of the plunger 32. The pressure chamber 36** is normally filled with a predetermined amount of hydraulic fluid such as silicone oil.

The plunger 32 is hollow and is provided with a reservoir chamber 35 therein which is connected with the pressure chamber 36 through an aperture 37 provided in the bottom wall **32*a* of the plunger 32. A check valve in the form of a ball 38 is disposed in the pressure chamber 36 to close the aperture 37. The ball 38 is biased by a spring 40 located within a cup-shaped retainer 39. The check valve 38 permits fluid flow only from the reservoir chamber 35 to the pressure chamber 36. A return spring 42 which biases the plunger 32 upwardly is disposed between the outer periphery of the retainer 39 and the closed end 31*b* of the body. The force of the spring 42 is larger than that of the spring 40**.

An annular groove 33 is formed in the outer surface of the lower portion **32*e* of the plunger 32. The annular groove 33 has a semi-circular cross-sectional configuration and communicates with the reservoir chamber 35 within the plunger 32 through four radially extending passages 34**.

The lower portion **32*e* of the plunger 32 is also provided with an outer peripheral groove 32*c* above the semi-circular groove 33 in the axial direction. The outer peripheral groove 32*c* is fitted with a synthetic rubber O-ring 45. The inner surface of the body 31 and the O-ring 45 are in fluid tight engagement with each other. An annular leakage clearance 46 is provided between the inner surface of the body 31 and the outer surface of the lower portion 32*e* below the O-ring 45 through which the silicone oil from the pressure chamber 36 will pass to the reservoir chamber 35. The leakage clearance 46 is required to be very precise and the surfaces defining the clearance must be finished very carefully since the quantity of the oil passing through the leakage clearance 46 is very small. An elastic synthetic rubber bag 43 is disposed within the reservoir chamber 35. The bag 43 has a tubular configuration with one end closed and the other end is provided with an annular outer flange 43***a* which is fitted into an inner groove 32*b* provided at the opened end of the plunger 32. In order to prevent the bag 43 from withdrawing from the plunger 32, a metal ring 44 is disposed in the opening of the bag 43. A flexible portion 43*b* of the bag 43 is always in contact with the surface of the oil in the reservoir chamber 35 and changes shape thereof in accordance with the variations of the volume of oil. The interior 43*c* of the bag 43 is disposed in communication with the atmosphere.

The fulcrum 47 is comprised of an upper portion 47*a*, a middle portion 47*b* and a sleeve 49 formed integrally with each other. The upper portion 47*a* has a convex-spherical configuration and is engaged with a complimentary concave spherical portion 22*b* provided at one end of the rocker arm 22. The middle portion 47*b* is provided with passages 48 through which the interior 43*c* of the bag 43 will communicate with the atmosphere. The sleeve 49 extends downwardly and is fitted between the body 31 and the upper portion 32*d* of the plunger 32. The clearance C1 between the outer surface of the sleeve 49 and the inner surface of the body 31 is smaller than the clearance C2 formed between the inner surface of the sleeve 49 and the outer surface of the upper portion 32*d* of the plunger 32.

The plunger 32 is biased in the upward direction by the spring 42 and the fulcrum 47 is biased in the downward direction by the rocker arm 22. Consequently, the lower end of the sleeve 49 is disposed in abutment with shoulder 32*f* of the plunger 32 so that the fulcrum 47 and the plunger 32 move as a unit. The upward movement of the fulcrum 47 and the plunger 32 is limited by an inverted cup-shaped member 50 disposed at the open end of the body 31 and the downward movement of the fulcrum 47 and the plunger 32 is limited by the stepped portion 31*c* of the body 31.

When the engine is started, the rocker arm 22 rotates in response to the rotation of the cam 24 counterclockwise about the fulcrum 47 and the stem 18 is moved downwardly against the valve spring 20 thereby opening the valve 16. The load of the valve spring 20 is increased so that the reaction force of the valve spring 20 is transmitted to the rocker arm 22. The reaction force rotates the rocker arm 22 in the clockwise direction about the point at which the rocker arm 22 and the cam 24 are in abutment with each other. Thus, the fulcrum 47 will be pressed downwardly so that the oil pressure within the pressure chamber 36 will be increased and the ball 38 seated on the valve seat 41. A very small amount of oil will then be leaked from the pressure chamber 36 to the reservoir chamber 35 through the leakage clearance 46, the semi-circular groove 33 and the passages 34.

In response to further rotation of the cam 24, the stem 18 will be moved upwardly by the valve spring 20 and at the same time the rocker arm 22 will rotate clockwise about the fulcrum 47. At this time, since the load of the valve spring 20 becomes nearly 0, no downward force is applied to the fulcrum 47 and the plunger 32 is moved upwardly relative to the body 31. Consequently, the oil pressure in the pressure chamber 36 is decreased and the ball 38 is released from the seat 41 against the force of the spring 40 whereby the oil in the reservoir chamber 35 can pass into the pressure chamber 36 through the hole 37. Accordingly, the lash adjuster 32 is returned to the original length thereof.

When the downward force is applied to the fulcrum from the rocker arm 22, the thrust force which is a horizontal component of the downward force is simultaneously applied to the fulcrum 47 and the plunger 32. Since the fulcrum 47 and the plunger 32 are not integral with each other and the clearance C1 is smaller than the clearance C2, the outer surface of the sleeve 49 and the inner surface of the body 31 are placed in contact with each other by most of the thrust force. By the presence of the lubricating oil in the clearance C1, the inner surface of the body 31 and the outer surface of the sleeve 49 are prevented from frictional wear while the inner surface of the body 31 and the outer surface of the plunger are not brought into contact with each other. Accordingly, the operating accuracy of the lash adjuster will be maintained. Furthermore, since the annular groove 33 is provided with a semi-circular cross-section, air will not remain in the annular groove when the lash adjuster 30 is assembled.

While the invention has been particularly shown and described with reference to a preferred embodiment thereof, it will be understood by those in the art that various changes in form and details may be made therein without departing from the spirit and scope of the invention.

What is claimed is:

1. A self-contained lash adjuster comprising a body having an axially extending blind bore therein with an opening at one end and a closed wall at the other end, a plunger slidably mounted in said blind bore, a reservoir chamber located in said plunger, a pressure chamber disposed between said plunger and said closed wall of said body, a check valve for allowing fluid flow only from said reservoir chamber to said pressure chamber through an aperture in said plunger, a return spring disposed between said closed wall of said body and said plunger to bias said plunger in the direction of said opening of said body, a leakage clearance between the inner surface of said body and the outer surface of said plunger, an annular groove provided on said outer surface of said plunger, radial passage means extending through said plunger in communication with said groove to connect said leakage clearance to said reservoir chamber, a transmitting member slidably inserted between the inside of said body and the outside of said plunger adjacent the opening at one end of the body, sealing means providing a seal between said plunger and said body intermediate said groove and said transmitting member, said one end of said transmitting member disposed in engagement with a shoulder portion of said plunger, a tubular elastic bag fixed to said plunger within said reservoir chamber with the closed end thereof being normally disposed in contact with fluid in said reservoir chamber and the interior of said bag being disposed in communication with the atmosphere, said closed end of said bag extending past said radial passage means, and the clearance between the inner surface of said body and the outer surface of said transmitting member being smaller than the clearance between the inner surface of said transmitting member and the outer surface of said plunger.

2. A self-contained lash adjuster as set forth in claim 1, wherein said transmitting member is comprised of a convex-spherical shaped fulcrum portion, a middle portion and a sleeve portion formed integrally with each other, said convex-spherical shaped fulcrum adapted to engage one end of a rocker arm and said sleeve being interposed between said body and said plunger with the aforesaid clearances.

3. A self-contained lash adjuster as set forth in claim 1, wherein said first groove has a semi-circular cross-sectional configuration.

* * * * *